US009216429B2

(12) United States Patent
Worthy

(10) Patent No.: US 9,216,429 B2
(45) Date of Patent: Dec. 22, 2015

(54) MIST GENERATING APPARATUS AND METHOD

(75) Inventor: Jude Alexander Glynn Worthy, Bedford (GB)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 852 days.

(21) Appl. No.: 12/592,930

(22) Filed: Dec. 4, 2009

(65) Prior Publication Data

US 2010/0230119 A1 Sep. 16, 2010

Related U.S. Application Data

(63) Continuation-in-part of application No. PCT/GB2008/001883, filed on Jun. 3, 2008.

(30) Foreign Application Priority Data

Jun. 4, 2007 (GB) ..... 0710663.6

(51) Int. Cl.
*B05B 7/00* (2006.01)
*A62C 31/02* (2006.01)
(Continued)

(52) U.S. Cl.
CPC ... *B05B 7/00* (2013.01); *A62C 2/00* (2013.01); *A62C 31/02* (2013.01); *B05B 7/0433* (2013.01); *B05B 7/0491* (2013.01)

(58) Field of Classification Search
CPC ..... A62C 2/00; A62C 31/02; B05B 7/00; B05B 7/0433; B05B 7/0491
USPC ..... 239/423, 424, 433
See application file for complete search history.

(56) References Cited

U.S. PATENT DOCUMENTS 1,169,433 A * 1/1916 Shelley ..... 239/416.3
1,535,491 A * 4/1925 Partlow ..... 239/128
(Continued)

FOREIGN PATENT DOCUMENTS

EP 1 163 931 12/2001
WO WO 97/38757 10/1997
(Continued)

OTHER PUBLICATIONS

International Searching Authority, International Search Report and Written Opinion issued in International Application No. PCT/GB2008/001883, Sep. 26, 2008, 9 pages.
(Continued)

*Primary Examiner* — Arthur O Hall
*Assistant Examiner* — Viet Le
(74) *Attorney, Agent, or Firm* — Perkins Coie LLP

(57) ABSTRACT

The present invention provides, inter alia, an apparatus for generating a mist. The apparatus includes (a) a first transport fluid passage having a first transport fluid inlet, a first transport fluid outlet, and a throat portion intermediate the first transport fluid inlet and the first transport fluid outlet, the throat portion having a cross sectional area which is less than that of either the first transport fluid inlet or the first transport fluid outlet; (b) at least one working fluid passage located radially outwardly of the first transport fluid passage and having a working fluid inlet and a working fluid outlet; (c) at least one second transport fluid passage having a second transport fluid inlet and a second transport fluid outlet in fluid communication with the working fluid passage; and (d) an outlet nozzle in fluid communication with the first transport fluid and working fluid outlets, wherein the second transport fluid passage has an outlet located in the working fluid passage upstream of the working fluid outlet. Systems and methods of generating a mist using such an apparatus are also provided. Methods for fire suppression and decontamination using such an apparatus are further provided. Mists generated using such an apparatus are further provided.

21 Claims, 3 Drawing Sheets

(51) Int. Cl.
*B05B 7/04* (2006.01)
*A62C 2/00* (2006.01)

(56) References Cited

U.S. PATENT DOCUMENTS

| | | | | |
|---|---|---|---|---|
| 5,312,041 | A * | 5/1994 | Williams et al. | 239/8 |
| 5,779,159 | A | 7/1998 | Williams et al. | |
| 5,810,252 | A * | 9/1998 | Pennamen et al. | 239/8 |
| 5,934,566 | A * | 8/1999 | Kanno et al. | 239/398 |
| 6,523,991 | B1 * | 2/2003 | Maklad | 366/163.2 |
| 2007/0210186 | A1 | 9/2007 | Fenton et al. | |
| 2008/0230632 | A1 | 9/2008 | Fenton et al. | |
| 2009/0314500 | A1 * | 12/2009 | Fenton et al. | 169/16 |
| 2010/0230119 | A1 | 9/2010 | Worthy et al. | |
| 2010/0301129 | A1 | 12/2010 | Fenton et al. | |
| 2011/0127347 | A1 | 6/2011 | Worthy et al. | |
| 2011/0203813 | A1 | 8/2011 | Fenton et al. | |

FOREIGN PATENT DOCUMENTS

| | | |
|---|---|---|
| WO | WO 00/37143 | 6/2000 |
| WO | WO 2005/082546 | 9/2005 |

OTHER PUBLICATIONS

International Searching Authority, International Preliminary Report on Patentability issued in International Application No. PCT/GB2008/001883, Dec. 7, 2009, 7 pages.

Image File Wrapper (IFW) of European Application No. EP2008762237, May 21, 2014 from the EPO Patent Register.

Image File Wrapper (IFW) of Australian Application No. AU2008259611, May 21, 2014 from the AusPat IP Australia Patent Database.

U.S. Appl. No. 12/381,584 (Publication No. 2009-0314500 A1) Co-Pending Related U.S. Appl. No. 12/592,930.

U.S. Appl. No. 12/996,348 (Publication No. 2011-0127347 A1) Co-Pending Related U.S. Appl. No. 12/592,930.

U.S. Appl. No. 12/742,046 (Publication No. 2011-0203813 A1) Co-Pending Related U.S. Appl. No. 12/592,930.

U.S. Appl. No. 12/741,995 (Publication No. 2012-0018531 A1) Co-Pending Related U.S. Appl. No. 12/592,930.

U.S. Appl. No. 12/741,941 (Publication No. 2010-0301129 A1) Co-Pending Related U.S. Appl. No. 12/592,930.

U.S. Appl. No. 10/590,527 (Publication No. 2008-0230632 A1) Co-Pending Related U.S. Appl. No. 12/592,930.

U.S. Appl. No. 10/590,456 (Publication No. 2007-0210186 A1) Co-Pending Related U.S. Appl. No. 12/592,930.

* cited by examiner

MIST GENERATING APPARATUS AND METHOD

CROSS-REFERENCE TO RELATED APPLICATIONS

This application is a continuation-in-part of and claims benefit to international application no. PCT/GB2008/001883 filed Jun. 3, 2008, which claims benefit to Great Britain Application No. 0710663.6 filed Jun. 4, 2007. All of the foregoing applications are incorporated by reference in their entireties as if recited in full herein.

FIELD OF THE INVENTION

The present invention relates to the field of mist generating apparatuses. More specifically, the invention is directed, inter alia, to an improved apparatus and method for generating liquid droplet mists, which may be used in, e.g., decontamination or fire suppression applications.

BACKGROUND OF THE INVENTION

Mist generating apparatuses are known and are used in a number of fields. For example, such apparatuses are used in fire suppression, decontamination and cooling applications, where the liquid droplet mists generated are more effective than a conventional fluid stream. Examples of such mist generating apparatuses can be found in international patent publications WO2005/082545 and WO2005/082546 to Pursuit Dynamics PLC.

SUMMARY OF THE INVENTION

According to a first embodiment of the present invention there is provided an apparatus for generating a mist comprising:

(a) a first transport fluid passage having a first transport fluid inlet, a first transport fluid outlet, and a throat portion intermediate the first transport fluid inlet and the first transport fluid outlet, the throat portion having a cross sectional area which is less than that of either the first transport fluid inlet or the first transport fluid outlet;

(b) at least one working fluid passage located radially outwardly of the first transport fluid passage and having a working fluid inlet and a working fluid outlet;

(c) at least one second transport fluid passage having a second transport fluid inlet and a second transport fluid outlet in fluid communication with the working fluid passage; and (d) an outlet nozzle in fluid communication with the first transport fluid and working fluid outlets, wherein the second transport fluid passage has an outlet located in the working fluid passage upstream of the working fluid outlet.

According to a second embodiment of the present invention there is provided a method of generating a mist. The method comprises the steps of:

(a) supplying a first portion of a transport fluid to a first transport fluid passage having a first transport fluid inlet, a first transport fluid outlet and a throat portion intermediate the first transport fluid inlet and the first transport fluid outlet, the throat portion having a cross sectional area which is less than that of either the first transport fluid inlet or the first transport fluid outlet;

(b) supplying a working fluid to at least one working fluid passage located radially outwardly of the first transport fluid passage and having a working fluid inlet and a working fluid outlet;

(c) supplying a second portion of transport fluid through at least one second transport fluid passage into the working fluid passage, wherein the second transport fluid passage has an outlet upstream of the working fluid outlet;

(d) imparting a shear force on the working fluid by way of the second portion of the transport fluid exiting the second transport fluid passage outlet, thereby partially atomising the working fluid as it passes through the working fluid passage; and (e) directing the partially atomised working fluid and the first portion of transport fluid to an outlet nozzle in fluid communication with the respective first transport fluid and working fluid outlets, wherein the respective outlets are arranged such that the first portion of transport fluid flow imparts a further shear force on the partially atomised working fluid to atomise the working fluid still further.

According to a third embodiment there is provided a system for generating a mist comprising an apparatus according to the present invention.

According to a fourth embodiment there is provided a mist made by a method according to the present invention.

According to a fifth embodiment of the present invention there is provided a method for decontaminating an area including an article within the area. This method comprises generating and distributing a decontamination mist within the area and/or on a surface of the article, wherein the decontamination mist is generated and distributed using an apparatus comprising:

(a) a first transport fluid passage having a first transport fluid inlet, a first transport fluid outlet, and a throat portion intermediate the first transport fluid inlet and the first transport fluid outlet, the throat portion having a cross sectional area which is less than that of either the first transport fluid inlet or the first transport fluid outlet;

(b) at least one working fluid passage located radially outwardly of the first transport fluid passage and having a working fluid inlet and a working fluid outlet;

(c) at least one second transport fluid passage having a second transport fluid inlet and a second transport fluid outlet in fluid communication with the working fluid passage; and (d) an outlet nozzle in fluid communication with the first transport fluid and working fluid outlets, wherein the second transport fluid passage has an outlet located in the working fluid passage upstream of the working fluid outlet.

According to a sixth embodiment of the present invention there is provided a fire suppression method. This method comprises generating and distributing within an area a mist sufficient to suppress a fire within the area using an apparatus comprising:

(a) a first transport fluid passage having a first transport fluid inlet, a first transport fluid outlet, and a throat portion intermediate the first transport fluid inlet and the first transport fluid outlet, the throat portion having a cross sectional area which is less than that of either the first transport fluid inlet or the first transport fluid outlet;

(b) at least one working fluid passage located radially outwardly of the first transport fluid passage and having a working fluid inlet and a working fluid outlet;

(c) at least one second transport fluid passage having a second transport fluid inlet and a second transport fluid outlet in fluid communication with the working fluid passage; and (d) an outlet nozzle in fluid communication with the first transport fluid and working fluid outlets, wherein the second transport fluid passage has an outlet located in the working fluid passage upstream of the working fluid outlet.

Preferred embodiments of the present invention will be described, by way of example only, with reference to the accompanying drawings.

DETAILED DESCRIPTION OF THE INVENTION

Figure 1:
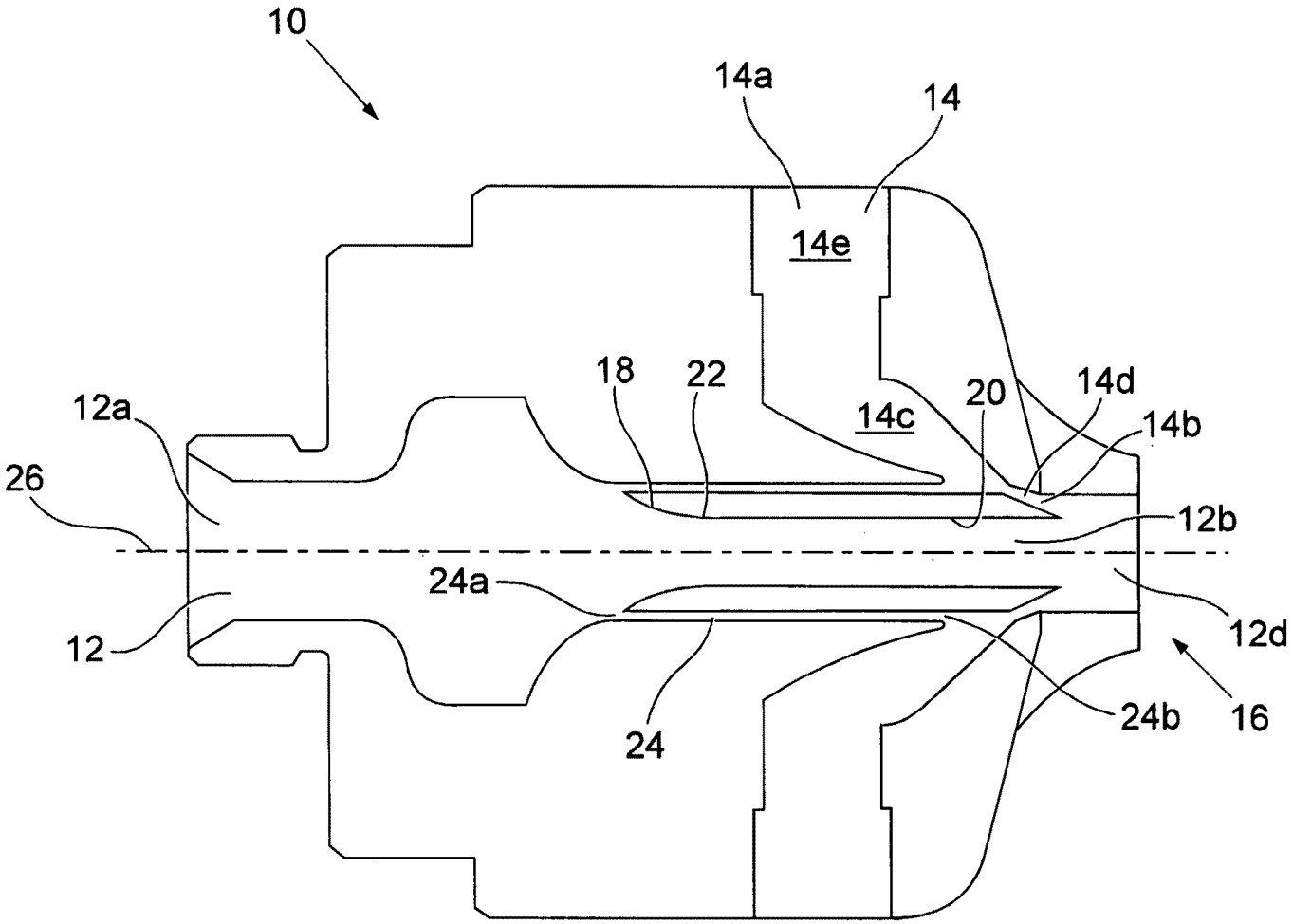
FIG. 1 is a cross sectional side view of part of a mist generating apparatus according to a first embodiment of the present invention.

In a first embodiment of the present invention, there is provided an apparatus for generating a mist comprising:

(a) a first transport fluid passage having a first transport fluid inlet, a first transport fluid outlet, and a throat portion intermediate the first transport fluid inlet and the first transport fluid outlet, the throat portion having a cross sectional area which is less than that of either the first transport fluid inlet or the first transport fluid outlet;

(b) at least one working fluid passage located radially outwardly of the first transport fluid passage and having a working fluid inlet and a working fluid outlet;

(c) at least one second transport fluid passage having a second transport fluid inlet and a second transport fluid outlet in fluid communication with the working fluid passage; and (d) an outlet nozzle in fluid communication with the first transport fluid and working fluid outlets, wherein the second transport fluid passage has an outlet located in the working fluid passage upstream of the working fluid outlet.

In one aspect of this embodiment, the second transport fluid inlet is in fluid communication with the first transport fluid passage such that the second transport fluid passage receives transport fluid from the first transport fluid passage. The second transport fluid passage has an inlet located in the first transport fluid passage upstream of the throat portion of the first transport fluid passage.

In this embodiment, the first fluid transport inlet or passage receives transport fluid from a first source. Alternatively, the first fluid transport passage receives transport fluid from a first source and the second transport fluid passage receives transport fluid from a second separate transport fluid source.

The working fluid outlet of the present embodiment may be located at various locations within the apparatus. For example, the working fluid outlet may be located radially outwardly from the first transport fluid throat, or radially outwardly from the first transport fluid outlet. The working fluid outlet may also be located adjacent the throat portion of the first transport fluid passage. In this aspect of the invention, the working fluid outlet may be substantially perpendicular to the longitudinal axis of the first transport fluid passage.

The working fluid outlet may be directed towards the longitudinal axis of the first transport fluid passage. Alternatively, the working fluid outlet may be substantially parallel to the longitudinal axis of the first transport fluid passage.

The second transport fluid passage and a portion of the working fluid passage adjacent the working fluid outlet may be arranged such that there is a substantially straight-through passageway between the inlet to the second transport fluid passage and the working fluid outlet.

In this embodiment, the first transport fluid passage is generally cylindrical in shape and the working fluid passage is generally annular in shape. Preferably, the working fluid passage circumscribes the first transport fluid passage.

In this embodiment, the working fluid passage may include a plurality of working fluid inlets. The apparatus of this embodiment may also comprise a plurality of second transport fluid passages. Preferably, the plurality of second transport fluid passages are arranged circumferentially around the first transport fluid passage.

In this embodiment, the first transport fluid passage has a protrusion which protrudes towards the longitudinal axis of the first transport fluid passage, the protrusion being located intermediate of the throat portion and outlet of the first transport fluid passage.

In a second embodiment of the present invention, there is provided a method of generating a mist. The method comprises the steps of:

(a) supplying a first portion of a transport fluid to a first transport fluid passage having a first transport fluid inlet, a first transport fluid outlet and a throat portion intermediate the first transport fluid inlet and the first transport fluid outlet, the throat portion having a cross sectional area which is less than that of either the first transport fluid inlet or the first transport fluid outlet;

(b) supplying a working fluid to at least one working fluid passage located radially outwardly of the first transport fluid passage and having a working fluid inlet and a working fluid outlet;

(c) supplying a second portion of transport fluid through at least one second transport fluid passage into the working fluid passage, wherein the second transport fluid passage has an outlet upstream of the working fluid outlet;

(d) imparting a shear force on the working fluid by way of the second portion of the transport fluid exiting the second transport fluid passage outlet, thereby partially atomising the working fluid as it passes through the working fluid passage; and (e) directing the partially atomised working fluid and the first portion of transport fluid to an outlet nozzle in fluid communication with the respective first transport fluid and working fluid outlets, wherein the respective outlets are arranged such that the first portion of transport fluid flow imparts a further shear force on the partially atomised working fluid to atomise the working fluid still further.

In this embodiment, the second portion of the transport fluid is directed to the second transport fluid passage from the first transport fluid passage.

In one aspect of this embodiment, the supply of the first portion of transport fluid to the first transport fluid passage is from a first source. In another aspect of this embodiment, the supply of the first portion of transport fluid to the first transport fluid passage is from a first source and the supply of the second portion of transport fluid to the second transport fluid passage is from a second separate transport fluid source.

In a further aspect of the embodiment, the step of supplying the second portion of the transport fluid through the at least one second transport fluid passage includes directing transport fluid in the first transport passage to an inlet of the second transport fluid passage located upstream of the throat portion of the first transport fluid passage. Preferably, the second portion of the transport fluid is directed through a plurality of second transport fluid passages which connect the first transport fluid passage and the working fluid passage.

In this embodiment, the method of generating the mist comprises the further step of creating a stationary aerodynamic shockwave in the first transport fluid passage. Preferably, the step of creating the stationary aerodynamic shockwave includes the step of passing the transport fluid over a protrusion or a recess in the first transport fluid passage.

Preferably, the method comprises the further step of passing the atomised working fluid through the stationary aerodynamic shockwave to atomise the working fluid further still.

A third embodiment of the present invention is a system for generating a mist. This system comprises an apparatus according to the present invention.

A fourth embodiment is a mist made by any of the methods according to the present invention. Such a mist has the properties disclosed herein and may be used in suitable applications such as, e.g., fire suppression and decontamination. The enhanced turbulence achieved in an apparatus for generating a mist of the present invention helps to both increase droplet formation (with smaller droplets) and also the turbulence of the generated mist. This has benefits in, e.g., fire suppression and decontamination of helping to force the mist to mix within the mist generator and to wet all surfaces and/or to mix with the hot gasses.

Thus, a fifth embodiment of the present invention is a method for decontaminating an area including an article within the area. This method comprises generating and distributing a decontamination mist within the area and/or on a surface of the article, wherein the decontamination mist is generated and distributed using an apparatus according to the present invention, including one that comprises:

(a) a first transport fluid passage having a first transport fluid inlet, a first transport fluid outlet, and a throat portion intermediate the first transport fluid inlet and the first transport fluid outlet, the throat portion having a cross sectional area which is less than that of either the first transport fluid inlet or the first transport fluid outlet;

(b) at least one working fluid passage located radially outwardly of the first transport fluid passage and having a working fluid inlet and a working fluid outlet;

(c) at least one second transport fluid passage having a second transport fluid inlet and a second transport fluid outlet in fluid communication with the working fluid passage; and (d) an outlet nozzle in fluid communication with the first transport fluid and working fluid outlets, wherein the second transport fluid passage has an outlet located in the working fluid passage upstream of the working fluid outlet. In this embodiment, an additive may be introduced into the working fluid to enhance the decontamination effect of the mist.

In one aspect of this embodiment, an "area" means an enclosed room, including a fixed (e.g., a room within a house or building) or portable (e.g., a tent) structure or an open space in which the decontamination mist may be effectively distributed such that decontamination of the intended area and/or an article within such area is achieved. In a further aspect of this embodiment, the "article" is, for example, a work surface, a person, an animal, an instrument, and equipment of all types. In the present invention, the equipment may include civilian or military air, land, or water-based vehicles, furniture of all kinds and other items typically found within homes, offices, hospitals, commercial buildings, and the like, including beds, desks, screens, credenzas, tables, chairs, lamps, surgical equipment, and the like.

In this embodiment, the decontamination mist may be used to, e.g., remove, deactivate, sterilize, and/or neutralize hazardous substances, including, for example, chemical, biological, and/or radiological substances. Thus, the selection of the working fluid and/or an additive for the working fluid will depend on the hazardous substance(s) to be removed, deactivated, sterilized, and/or neutralized. It is contemplated that conventional decontamination materials will be used for the working fluid and/or additive and that their selection is within the skill of the art.

The present embodiment has the additional benefit of wetting or quenching of explosive or toxic atmospheres. This process may utilize just a transport fluid such as steam, and/or may utilize a working fluid such as water and/or water with chemical or biological additives or another suitable fluid. The latter configurations could be used for placing the hazardous substance, e.g., explosive or toxic substances, in solution for safe disposal.

The mist produced by an apparatus of the present invention may be advantageously employed for combating airborne contaminants, e.g., where there has been a leakage or escape of chemical or biological materials in liquid or gaseous form. The mist effectively creates a blanket saturation of the prevailing atmosphere in the area providing a thorough wetting result. In the case where chemical or biological materials are involved, the mist wets the hazardous materials and occasions, e.g., their precipitation or neutralization. As set forth above, additional treatment may be provided by the introduction or entrainment of chemical or biological additives into the working fluid. For example disinfectants may be entrained or introduced into the or an apparatus of the present invention, and introduced into an area, e.g., a room to be disinfected in a mist form.

It is envisaged that the working fluid may itself be the active agent in decontamination applications, or it may be a carrier fluid into which the active agents (whether solid, powder, or liquid, chemical, biological or other) are mixed and/or entrained.

For some decontamination applications, such as some animal decontamination or agricultural decontamination applications, no premix of the chemicals may be required as the chemicals can be entrained directly into the apparatus and mixed simultaneously. This greatly reduces the time required to start decontamination and also eliminates the requirement for a separate mixer and holding tank.

A sixth embodiment of the present invention is a fire suppression method. This method comprises generating and distributing within an area a mist sufficient to suppress a fire within the area using an apparatus comprising:

(a) a first transport fluid passage having a first transport fluid inlet, a first transport fluid outlet, and a throat portion intermediate the first transport fluid inlet and the first transport fluid outlet, the throat portion having a cross sectional area which is less than that of either the first transport fluid inlet or the first transport fluid outlet;

(b) at least one working fluid passage located radially outwardly of the first transport fluid passage and having a working fluid inlet and a working fluid outlet;

(c) at least one second transport fluid passage having a second transport fluid inlet and a second transport fluid outlet in fluid communication with the working fluid passage; and (d) an outlet nozzle in fluid communication with the first transport fluid and working fluid outlets, wherein the second transport fluid passage has an outlet located in the working fluid passage upstream of the working fluid outlet. In this embodiment an additive may be introduced into the working fluid to enhance the fire suppression effect of the mist.

In one aspect of this embodiment, an "area" means an enclosed room or an open space in which the mist may be effectively distributed such that fire suppression in the intended area is achieved.

Turning now to the figures, FIG. 1 shows a first embodiment of a mist generating apparatus 10 according to the present invention. The apparatus 10 comprises a first transport fluid passage 12, a working fluid passage 14 and an outlet nozzle 16.

The first transport fluid passage 12 is generally cylindrical in shape and has a first transport fluid inlet 12*a* and a first transport fluid outlet 12*b*. The first transport fluid passage 12 also has convergent-divergent internal geometry. The convergent-divergent geometry comprises a converging portion 18, a diverging portion 20 and a throat portion 22 located between the converging and diverging portions 18, 20. The throat portion 22 is located intermediate the first transport fluid inlet 12*a* and the first transport fluid outlet 12*b* and has a cross sectional area which is less than that of either the first transport fluid inlet 12*a* or the first transport fluid outlet 12*b*.

The working fluid passage 14 is located radially outwardly of the first transport fluid passage 12. In this arrangement, the working fluid passage 14 partially circumscribes the first transport fluid passage 12. The working fluid passage 14 has a working fluid inlet 14*a* and a working fluid outlet 14*b*. A portion 14*e* of the working fluid passage 14 adjacent the working fluid inlet 14*a* is substantially perpendicular to the longitudinal axis 26 of the first transport fluid passage 12. The working fluid passage 14 also has a converging portion 14*c* between the inlet 14*a* and the outlet 14*b*. A portion 14*d* of the working fluid passage adjacent the working fluid outlet 14*b* is inclined relative to the longitudinal axis 26 of the first transport fluid passage 12, such that the working fluid outlet 14*b* itself is also directed towards the longitudinal axis 26 of the first transport fluid passage 12.

The outlet nozzle 16 is in fluid communication with the first transport fluid outlet 12*b* and the working fluid outlet 14*b*. The length of the outlet nozzle 16 may be varied depending on the desired application, shape of the mist plume, required projection distance of the mist plume, etc. It may also be scaled up or down if the apparatus 10 is to be scaled up or down. It is therefore simplest to give the size of the outlet nozzle as a function of the throat diameter T rather than in absolute units. The outlet nozzle may vary in length between 0 T and 25 T, more preferably between 0 T and 12 T.

The apparatus 10 also comprises a second transport fluid passage 24 which allows fluid communication between the first transport fluid passage 12 and the working fluid passage 14. The second transport fluid passage 24 has a second fluid inlet 24*a* located in the first transport fluid passage 12 upstream of the throat 22. The second transport fluid passage 24 also has a second fluid outlet 24*b* located in the working fluid passage 14 upstream of the working fluid outlet 14*b*.

In the embodiment of FIG. 1, the working fluid outlet 14*b* is located radially outwardly from first transport fluid outlet 12*b*. Also, the second transport fluid passage 24 and the portion 14*d* of the working fluid passage 14 adjacent the working fluid outlet 14*b* are arranged such that there is a substantially straight-through passageway between the second inlet 24*a* of the second transport fluid passage 24 and the working fluid outlet 14*b*.

In the embodiment of FIG. 1, the apparatus 10 includes a mixing chamber 12*d* located downstream of the working fluid outlet 14*b*. The mixing chamber 12*d* allows further mixing and atomisation of working fluid thereby creating even smaller droplet sizes. The mixing chamber 12*d* is short in comparison to the length of the first transport fluid passage 12. Typically, the mixing chamber 12*d* is approximately 10 mm in length. However, it should be appreciated that dimensions of the mixing chamber 12*d* may be altered depending on, inter alia, the type of transport fluid and/or working fluid being used, the application of the apparatus 10, the length of the outlet nozzle 16 and whether the apparatus has been scaled up or down. Some embodiments may have no mixing chamber, or a much longer mixing chamber.

An exemplary operation of the first embodiment will now be described. A working fluid, such as water for example, is introduced to the working fluid passage 14 from a working fluid source (not shown). The working fluid flows along the working fluid passage 14 and exits the working fluid outlet 14*b* at the outlet nozzle 16. Since the working fluid outlet 14*b* is directed towards the longitudinal axis 26 of the first transport fluid passage 12, the working fluid exits the working fluid outlet 14*b* and comes into contact with the transport fluid. A transport fluid such as steam for example, is introduced to the first transport fluid passage 12 from a transport fluid source (not shown). The geometry of the convergent-divergent portion 18, 20 of the first transport fluid passage 12 acts as a Venturi section, accelerating the transport fluid as it passes there through. The transport fluid exits the first transport fluid outlet 12*b* at the outlet nozzle 16. The flow through a convergent-divergent nozzle, e.g., the convergent-divergent portion 18, 20, can be controlled by altering the upstream flow properties. Controlling the upstream flow properties can be used to accelerate the transport fluid through the convergent-divergent portion 18, 20 such that it is supersonic along some or all of the diverging portion 20 or even such that the transport fluid exits the outlet nozzle 16 at supersonic velocities. The flow properties of the transport fluid may be controlled by placing a transport fluid controller (not shown) between the transport fluid source and the first transport fluid inlet 12*a*.

Upstream of the convergent-divergent portion 18, 20 a portion of the transport fluid also flows through the second transport fluid passage 24 towards the working fluid passage 14. The transport fluid enters at the second fluid inlet 24*a* and exits at the second fluid outlet 24*b*. The transport fluid enters the working fluid passage 14 upstream of the working fluid outlet 14*b*. As the transport fluid enters the working fluid passage 14 it imparts a shear force on the working fluid thereby partially atomising the working fluid as it passes through the working fluid passage 14 and/or creating a bubble flow regime. As used herein, "partially atomised" means that the working fluid is no longer a continuous flow of liquid but has been broken up into droplets of working fluid carried in the transport fluid and "bubble flow" is bubbles of transport fluid carried in a continuum of working fluid. Depending on the transport and working fluid flow properties (e.g. pressure, velocity, and their relative mass flow rates) and the dimensions of the working fluid passage, the flow will be at either extreme, or it may be somewhere between the two. The flow may also vary over time between the two extremes, due to fluctuations, such as turbulence. Such properties may be varied by the operator depending on the application.

With the first portion of the transport fluid flowing at such high velocity and the partially atomised working fluid exiting the working fluid passage 14 at the working fluid outlet 14*b*, the partially atomised working fluid is subjected to further shear forces by the transport fluid. The result of this is that the partially atomised working fluid is atomised still further by the transport fluid and a dispersed droplet flow regime is produced having extremely small water droplets. The turbulence created by the transport fluid also aids in the atomisation of the working fluid. Also, the expansion of the working fluid, or working fluid mixture, exiting the outlet nozzle 16 causes further atomisation of the working fluid. Furthermore, the expansion and/or contraction of transport fluid, or transport fluid mixture, may enhance further atomisation of the working fluid. "Atomised" in this context should be understood to mean break down into very small particles or droplets.

The apparatus 10, therefore, creates a flow of substantially uniform sized droplets from the working fluid, e.g., typically 90% of the droplets by frequency have a diameter below 4 μm. Due to the fact that the transport fluid is transported centrally along the first transport fluid passage 12, the apparatus is capable of projecting the droplets a great distance. For example, using an apparatus according to the present invention, droplets have been projected over distances up to 16 m from the nozzle exit. The projection distance may be varied and/or controlled to fit a given application by varying a number of parameters, including, e.g., the velocity of the transport fluid, the design of the convergent-divergent nozzle, as well as the mass flow ratios of the transport and working fluids, etc.

Figure 2:
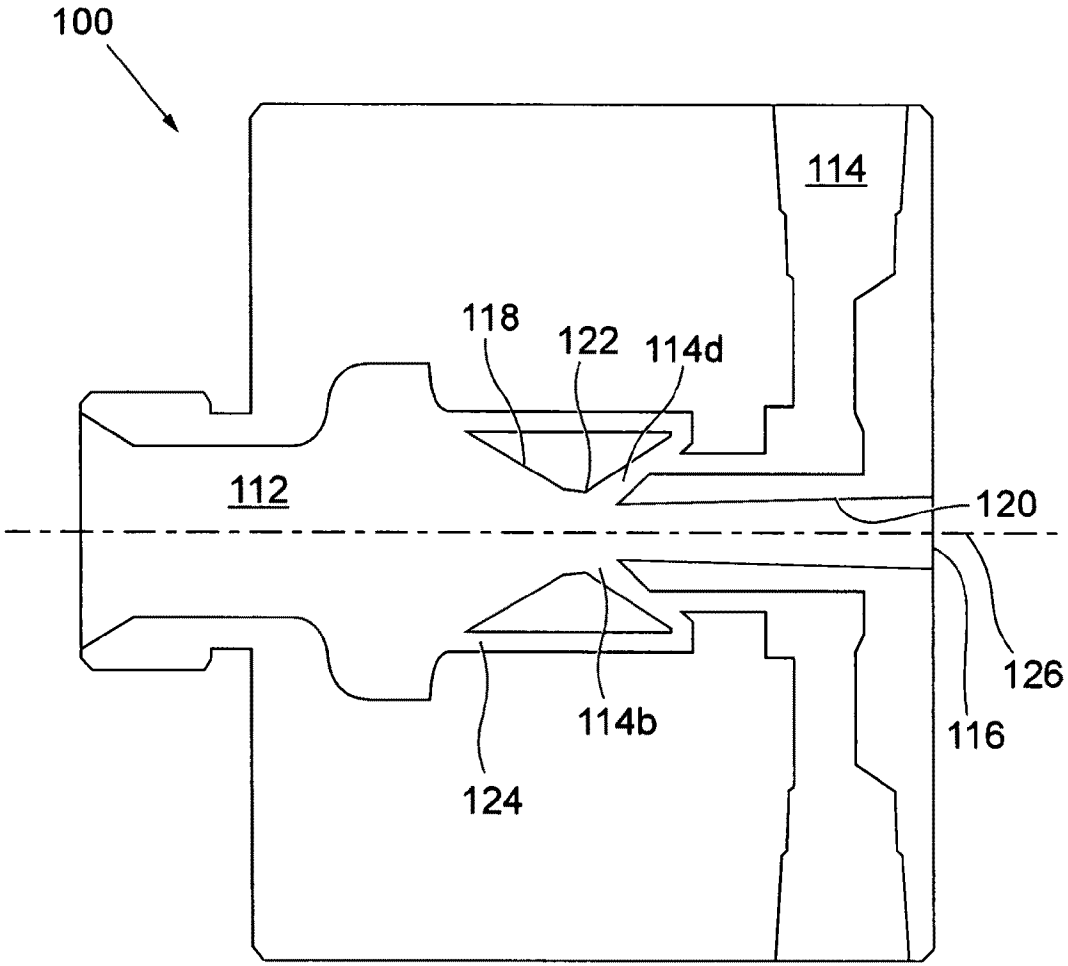
FIG. 2 is a cross sectional side view of part of a mist generating apparatus according to a second embodiment of the present invention.

Turning now to FIG. 2, it shows a second embodiment of the mist generating apparatus 100. In FIG. 2, the working fluid outlet 114*b* is located adjacent the throat portion 122 of the convergent-divergent portion 118, 120. In this arrangement a portion 114*d* of the working fluid passage 114 adjacent the working fluid outlet 114*b* is inclined relative to the longitudinal axis 126 of the first transport fluid passage 112, such that the working fluid outlet 114*b* itself is also directed towards the longitudinal axis 126 of the first transport fluid passage 112.

The operation of the second embodiment is similar to that of the first embodiment, the major difference being that the working fluid exits the working fluid passage 114 adjacent the throat portion 122 of the convergent-divergent portion 118, 120 and the working fluid enters the first transport fluid passage 112 against the flow of the transport fluid. In the second embodiment, the working fluid is again partially atomised by the transport fluid exiting the second transport fluid passage 124 upstream of the working fluid outlet 114*b*. The partially atomised working fluid entering the first transport fluid passage 112 at the throat portion 122 is subjected to the same shearing by the accelerated transport fluid as in the first embodiment. As explained above, the partially atomised working fluid enters the first transport fluid passage 112 against the flow of the transport fluid. This aids the shearing effect of the accelerated transport fluid, thus increasing the atomisation of the working fluid. In this embodiment, the main shearing atomisation takes place adjacent the throat portion 122, i.e. where the transport fluid is flowing at sonic or supersonic velocities. This shearing atomisation process is therefore extended through the entire divergent portion 120 towards the outlet nozzle 116. Furthermore, working fluid located on the walls of the divergent portion 120 is stripped therefrom by the transport fluid and the expansion of the working fluid exiting at the outlet nozzle 116 causes further atomisation of the working fluid.

Figure 3:
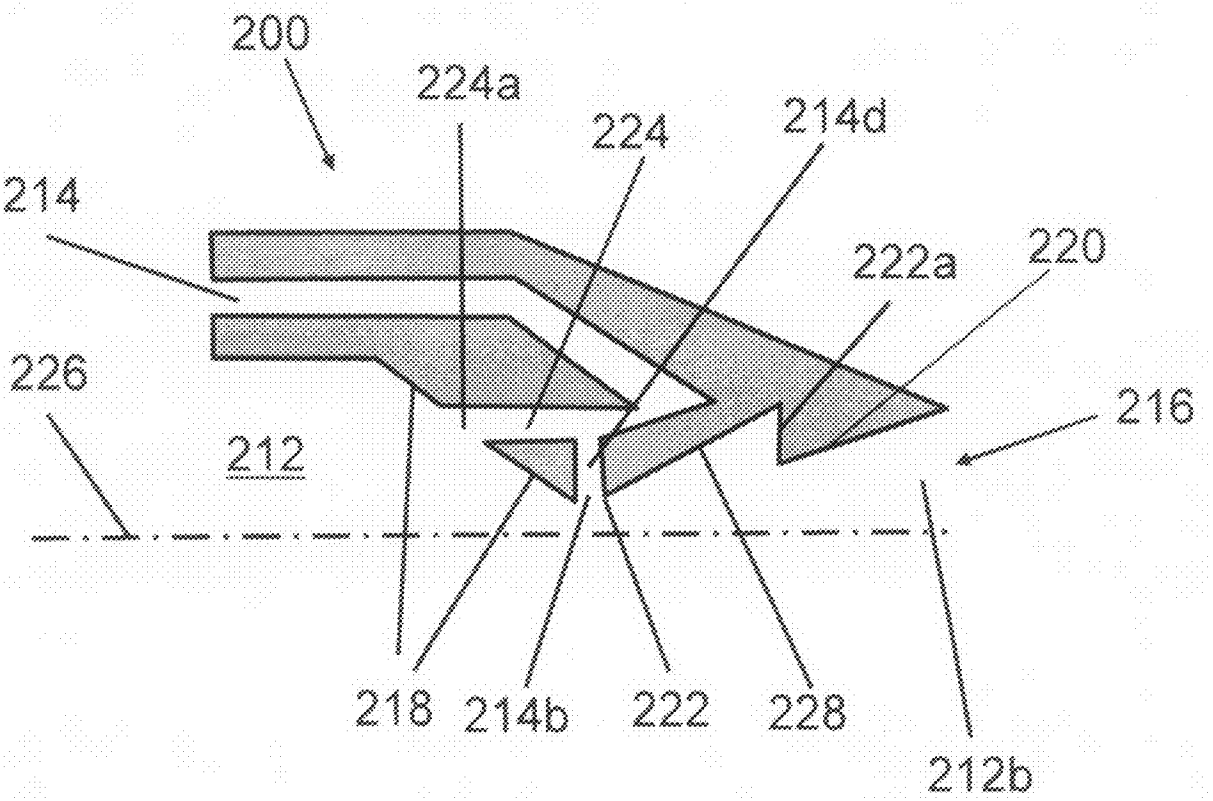
FIG. 3 is a cross sectional side view of part of a mist generating apparatus according to another aspect of the present invention.

Turning now to FIG. 3, it shows a portion of another aspect of the mist generating apparatus 200, which is a modification of the embodiment shown in FIG. 2. In FIG. 3, the working fluid passage 214 is an annular passage that is aligned with the longitudinal axis 226 and radially outward of the transport fluid passage 212. The working fluid inlet 214*a* (not shown) may be a radial inlet as shown in FIGS. 1 and 2 or it may be an axially aligned port that feeds into an annular plenum (not shown) that supplies the working fluid passage 214. The second fluid inlet 224*a* feeds the second transport fluid passage 224 and is located such that transport fluid is drawn into it in the convergent portion 218 of the convergent-divergent portion 218, 220. The transport fluid passage 224 may be a series of circumferentially spaced passages or drillings, or it may be an annular space fed by a second fluid inlet 224*a*, which is a series of circumferentially spaced holes, or other such arrangements that enable the device to be manufactured readily as would occur to one skilled in the art. In this aspect of the invention, the fluid in the second transport fluid passage 224 meets the working fluid in the working fluid passage 214 head on, leading to high levels of shear between the two fluids helping to partially atomise the working fluid. This mixture of transport and working fluid then enters the main transport fluid passage 212 at, or adjacent to, the throat portion 222. The portion 214*d* of the working fluid passage 214 adjacent the working fluid outlet 214*b* is substantially perpendicular to the direction of the flow in the transport fluid passage such that the working fluid outlet 214*b* is directed towards the longitudinal axis 226 of the first transport fluid passage 212. This leads to high levels of shear between the two fluids and aids in the further atomisation of the working fluid. In FIG. 3, the divergent portion 220 of the transport fluid passage 212 includes a protrusion 228, which protrudes towards the longitudinal axis 226 of the transport fluid passage 212. The protrusion 228 is located intermediate of the throat portion 222 and outlet 212*b* of the transport fluid passage 212. The protrusion 228 produces a stepped portion which includes a ring-shaped surface 222*a* (dimensions exaggerated for clarity in this image), which lies in a plane that is substantially perpendicular to the longitudinal axis 226.

The purpose of the portion 228 is to create a stationary aerodynamic shockwave in the apparatus 200.

The operation of this aspect of the invention is similar to that of the first and second embodiments, the major difference being that the dispersed droplet flow regime exiting the outlet nozzle 216 passes through the stationary aerodynamic shockwave. This shockwave creates further atomisation of the dispersed droplet flow regime.

Referring now back to FIG. 1, the mist generating apparatus 10 provides for improved atomisation by pre-atomising the working fluid upstream of the working fluid outlet 14*b* and providing centralised transportation of the transport fluid. Pre-atomising the working fluid upstream of the working fluid outlet 14*b* results in less transport fluid being required to produce the dispersed droplet flow regime. This increases the efficiency of the apparatus 10. Also, providing centralised transportation of the transport fluid allows the dispersed droplet flow regime to be projected further than conventional methods.

Modifications and improvements may be made to the above without departing from the scope of the present invention. For example, although the portion 14*e* of the working fluid passage 14 adjacent the working fluid inlet 14*a* has been illustrated and described above as being substantially perpendicular to the longitudinal axis 26 of the first transport fluid passage 12, it should be appreciated that the portion 14*e* of the working fluid passage 14 adjacent the working fluid inlet 14*a* may be substantially parallel to the longitudinal axis 26 of the first transport fluid passage 12. In this case, the working fluid passage 14 is generally annular in shape and circumscribes the first transport fluid passage 12.

Also, although the working fluid passage 14 has been described above as having one working fluid inlet 14*e*, it should be appreciated that working fluid passage 14 may have a plurality of working fluid inlets 14*e*.

Also, although the portion 14*d* of the working fluid passage 14 adjacent the working fluid outlet 14*b* has been described and illustrated above as being inclined relative to the longitudinal axis 26 of the first transport fluid passage 12, it should be appreciated that the portion 14*d* of the working fluid passage 14 adjacent the working fluid outlet 14*b* may be substantially parallel to the longitudinal axis 26 of the first transport fluid passage 12.

Furthermore, with respect to FIG. 2, although the portion 114*d* of the working fluid passage 114 adjacent the working fluid outlet 114*b* has been described and illustrated above as being inclined relative to the longitudinal axis 126 of first transport fluid passage 112, it should be appreciated that the portion 114*d* of the working fluid passage 114 adjacent the working fluid outlet 114*b* may be substantially perpendicular to the longitudinal axis 126 of the first transport fluid passage 112.

Altering the angle of inclination of the portion 114*d* relative to the longitudinal axis 126 alters the angle at which the working fluid exiting the working fluid outlet 114*b* impinges upon the transport fluid in the first transport fluid passage 112. This affects the amount of shear between the two fluids and hence affects the atomisation process and the degree of turbulence generated. Altering the angle in this manner may be used to optimise the design for a particular application and/or for use with particular transport and or working fluids. Thus, it should also be appreciated that the angle of inclination between the portion 14*d*, 114*d* of the working fluid passage 14, 114 adjacent the working fluid outlet 14*b*, 114*b* and the longitudinal axis 26, 126 of the first transport fluid passage 12, 112 may be any angle between 0 and 90 degrees.

Also, although the apparatus 10 has been illustrated and described above as having a single second transport fluid passage 24, it should be appreciated that the apparatus 10 may comprise a plurality of second transport fluid passages. In this case, the second transport fluid passages may be arranged, e.g., circumferentially around the first transport fluid passage 12. And, although the apparatus 10 has been illustrated and described above as having a single second fluid inlet 24*a* it should be appreciated that the apparatus 10 may comprise a plurality of second fluid inlets. In this case, the second fluid inlets may be arranged, e.g., circumferentially around the first transport fluid passage 12 e.g. as a series of holes or slots that supply the second transport fluid passage 24.

Furthermore, with respect to FIG. 3, although the portion 228 has been illustrated and described above as creating a stationary aerodynamic shockwave in the apparatus 200, it should be appreciated that a stationary aerodynamic shockwave may be created in the apparatus 200 by selecting a suitable geometry of the apparatus 200 and/or by controlling the upstream properties of the transport fluid before it enters the first transport fluid passage 212.

Although the second transport fluid passage 24 has been illustrated and described above as receiving transport fluid from the first transport fluid passage 12 by directing a portion of transport fluid from the first transport fluid passage 12 to the second transport fluid passage 24, it should be appreciated that the second transport fluid passage 24 may receive transport fluid from a separate source of transport fluid. For example, if the first transport passage 12 receives transport fluid from a first source, the second transport fluid passage 24 may receive transport fluid from a second separate source. The second separate source may supply a different type of transport fluid or both the first and second transport fluids may supply the same type of transport fluid. If there is a second transport fluid source, this may have its own transport fluid controller.

Furthermore, although the transport fluid has been described above as exiting the outlet nozzle 16 at a supersonic velocity, it should be appreciated that, by alternative arrangement of the internal geometry of the first transport fluid passage 12, and or by controlling the flow properties (e.g. temperature, pressure, density, or dryness fraction in the case of steam) of the transport fluid, the transport fluid may exit the outlet nozzle 16 at lower, sonic or subsonic, velocities.

Also although the outlet nozzle 16 is shown with substantially parallel sides in FIG. 1, it should be understood that other nozzle shapes are envisaged, depending on the desired shape of the mist plume created by the mist generating apparatus, the velocity of the fluids (and hence how far the mist projects), etc. Thus, the outlet nozzle 16 may have a convergent or divergent profile, and may have walls that have straight sides or a curving profile or other such shapes. In some embodiments, it may be desirable that the outlet nozzle 16 have a wall profile that is parallel to or substantially a continuation of the walls of the diverging portion 20 of the transport fluid passage 12.

Also, although the working fluid outlet 14*b*, 114*b* has been illustrated above as being annular, it should be appreciated that the working fluid outlet 14*b*, 114*b* may take different configurations, such as, e.g., it may comprise a series of holes circumscribing the first transport fluid passage 12, 112. Using a series of holes instead of an annular outlet increases the dispersion of the working fluid.

Although the working fluid has been described above as being water, it should be appreciated that the working fluid may be any suitable liquid and may also include an additive (e.g. a surfactant) or a decontaminant. Similarly, although the transport fluid has been described above as being steam, it should be appreciated that the transport fluid may also be a gas, such as, e.g., compressed air, Carbon Dioxide, Nitrogen, Helium, or the like.

A transport fluid controller may be used in conjunction with the apparatuses of the present invention. Such a device is used to control the flow conditions of the transport fluid. Thus, the transport fluid controller may be a pressure controller or a heater to change/control the pressure and/or temperature of the transport fluid or a condensation trap to remove water that has condensed out where the transport fluid is steam. Alternatively, the transport fluid source may be designed so as to provide the required flow properties without recourse to a separate transport fluid controller. The transport fluid source may be, e.g., a compressor, or a steam generator or bottled gas or other suitable source of a transport fluid. An example of a pressure controller is a manually operated valve that can be located upstream of the transport fluid inlet (preferably at the transport fluid source). The valve may be any type of valve that is capable of operating as a variable restriction to the transport fluid flow. A pressure measurement method, such as a pressure tapping located close to the transport fluid inlet and linked to a pressure measuring device may be used to determine the pressure of the transport fluid entering the apparatus of the present invention. An operator may adjust the manually operated valve so that the pressure of the transport fluid entering the transport fluid inlet is maintained at a desired value or within a desired range. In a more automated application, the system may comprise a pressure measurement method linked to a pressure controller (e.g., a pressure regulator) and an automatic controller, such that the automatic controller adjusts the pressure controller so as to maintain the pressure at the transport fluid inlet at a predetermined value or within a predetermined range.

Also, although the apparatus 10 described in FIG. 1 above has been described as including a mixing chamber 12*d* located downstream of the working fluid outlet 14*b*, it should be appreciated that the mixing chamber 12*d* is optional and is not essential for the function of the apparatus 10.

Furthermore, although the apparatus 200 has been described above as having a protrusion 228 which creates a stationary aerodynamic shockwave in the first transport fluid passage 212, it should be appreciated that a stationary aerodynamic shockwave may also be created by a recess in the first transport fluid passage. Also a stationary aerodynamic shockwave may be created in the apparatus by configuration of the internal geometry of the apparatus and/or by varying, inter alia, the flow conditions (e.g. pressure, temperature, density etc.) of the transport fluid and or working fluid. A working fluid controller may be installed at the working fluid source or between the working fluid source and the working fluid inlet 14*a*. This may be a flow rate controller such as a variable restriction valve so that the mass flow rate of the working fluid can be altered or controlled. Furthermore, the working fluid controller, in conjunction with the transport fluid controller, may be automatically operated by a programmable controller. Such a programmable controller would ensure that the apparatus operated in the desired manner in, e.g., an environment too hazardous for human operatives.

It should be understood that the apparatuses 10, 100, 200 are schematic illustrations. For production purposes the embodiments of the present invention may be made from a number of components that have been created (e.g. cast or machined) such that they fit together and are attached to each other by e.g. bolts or screws or other such fittings. Such design methods and manufacturing techniques would be known and understood by one skilled in the art. Moreover, conventional materials, such as, e.g., stainless steel or brass may be used to manufacture the apparatuses of the present invention. The selection of a suitable material is within the skill of the art and may be influenced by the environment in with the apparatus will operate.

In the present invention, one or more apparatuses for generating a mist may be used to achieve the intended method, e.g., decontamination or fire suppression. Thus, multiple apparatuses of the present invention, e.g., from about 2 to about 50 or more, may be used when, e.g., the volume of the area is too large for a single apparatus to fill in a timely manner or to achieve the desired result, e.g., decontamination or fire suppression. The number and distribution pattern of the apparatuses may be determined by one skilled in the art based on a number of factors, including the volume of the area, the speed at which the area must be filled with the mist, the size and flow properties of the apparatuses used, etc.

The following example is provided to further illustrate the apparatuses and methods of the present invention. The example is illustrative only and is not intended to limit the scope of the invention in any way.

EXAMPLE 1

Table 1 below gives some experimental results generated using two representative nozzles according to the present invention. One nozzle was within the scope of FIG. 1 ("First Embodiment") and one was within the scope of FIG. 2 ("Second Embodiment"). In these non-limiting examples the transport fluid was compressed air and the working fluid was water. The data presented below were measured 5 m from each nozzle exit using a Malvern Spraytec® from Malvern Instruments Inc. This device uses laser diffraction to determine the number and size of the mist droplets. This method works by firing a laser beam through the mist plume. Optical sensors on the other side of the plume pick up the light from the laser, which has been deflected to a greater or lesser extent depending on the size of any particle(s) the light has impinged upon. In-built algorithms in the Malvern Spraytec® then allow it to calculate the number and size of the droplets present in the mist plume. Having determined the droplet sizes present in the plume, the Spraytec performed further calculations to determine the D,90, which is a common measurement parameter used in industry. Ninety percent of the total number of droplets by frequency in the mist plume have a diameter which is equal to or less than the D,90.

TABLE 1

| Nozzle | Gas Pressure [barG] | Water Pressure [barG] | Mass flow rate ratio | D,90 [μm] |
|---|---|---|---|---|
| First Embodiment | 11 | 15.7 | 6.5 | 2.9 |
| Second Embodiment | 11 | 14.13 | 5.9 | 2.5 |

The present invention is not to be limited in scope by the specific embodiments described herein. Indeed, various modifications of the invention in addition to those described herein will become apparent to those skilled in the art from the foregoing description and the accompanying figures. Such modifications are intended to fall within the scope of the appended claims.

What is claimed is:

1. An apparatus for generating a mist comprising:

(a) a first transport fluid passage disposed around a longitudinal axis and having a first transport fluid inlet, a first transport fluid outlet, and a converging throat portion intermediate the first transport fluid inlet and the first transport fluid outlet, the throat portion having a cross sectional area which is less than that of either the first transport fluid inlet or the first transport fluid outlet;

(b) at least one working fluid passage disposed around the longitudinal axis, located radially outwardly, from the longitudinal axis, and circumscribing the first transport fluid passage, and having a working fluid inlet and a working fluid outlet;

(c) at least one second transport fluid passage disposed around the longitudinal axis and having a second transport fluid inlet and a second transport fluid outlet in fluid communication with the working fluid passage; and (d) an outlet nozzle in fluid communication with the first transport fluid and working fluid outlets, wherein the second transport fluid outlet being located in the working fluid passage upstream of the working fluid outlet so that a transport fluid in the second transport fluid passage partially atomises a working fluid within the working fluid passage to create a partially atomised working fluid, the partially atomised working fluid exiting the working fluid outlet and entering the first transport fluid passage such that the partially atomised working fluid is further atomised by a flow of transport fluid in the first transport fluid passage prior to the flow of transport fluid in the first transport fluid passage exiting the outlet nozzle.

2. An apparatus for generating a mist as claimed in claim 1, wherein the second transport fluid inlet is in fluid communication with the first transport passage such that the second transport fluid passage receives transport fluid from the first transport fluid passage.

3. An apparatus for generating a mist as claimed in claim 1, wherein the second transport fluid passage has an inlet is located in the first transport fluid passage upstream of the throat portion of the first transport fluid passage.

4. An apparatus for generating a mist as claimed in claim 1, wherein the working fluid outlet is located radially outwardly from the first transport fluid throat.

5. An apparatus for generating a mist as claimed in claim 1, wherein the working fluid outlet is located radially outwardly from the first transport fluid outlet.

6. An apparatus for generating a mist as claimed in claim 1, wherein the working fluid outlet is directed towards the longitudinal axis of the first transport fluid passage.

7. An apparatus for generating a mist as claimed in claim 4, wherein the second transport fluid passage and a portion of the working fluid passage adjacent the working fluid outlet are arranged such that there is a substantially straight-through passageway having no obstruction in the cross-sectional area of the second transport fluid passage between the inlet to the second transport fluid passage and the working fluid outlet.

8. An apparatus for generating a mist as claimed in claim 1, wherein the working fluid outlet is located adjacent the throat portion of the first transport fluid passage.

9. An apparatus for generating a mist as claimed in claim 8, wherein the working fluid outlet is substantially perpendicular to the longitudinal axis of the first transport fluid passage.

10. An apparatus for generating a mist as claimed in claim 1, wherein the first transport fluid passage has a protrusion which protrudes towards the longitudinal axis of the first transport fluid passage, the protrusion being located intermediate of the throat portion and outlet of the first transport fluid passage.

11. A method of generating a mist, the method comprising the steps of:

(a) supplying a first portion of a transport fluid to a first transport fluid passage disposed around a longitudinal axis and having a first transport fluid inlet, a first transport fluid outlet and a converging throat portion intermediate the first transport fluid inlet and the first transport fluid outlet, the throat portion having a cross sectional area which is less than that of either the first transport fluid inlet or the first transport fluid outlet;

(b) supplying a working fluid to at least one working fluid passage disposed around the longitudinal axis, located radially outwardly, from the longitudinal axis, and circumscribing the first transport fluid passage and having a working fluid inlet and a working fluid outlet;

(c) supplying a second portion of transport fluid through at least one second transport fluid passage disposed around the longitudinal axis into the working fluid passage, wherein an outlet of the second transport fluid passage being located in the working fluid passage upstream of the working fluid outlet so that a transport fluid in the second transport fluid passage partially atomises a working fluid within the working fluid passage to create a partially atomised working fluid, the partially atomised working fluid exiting the working fluid outlet and entering the first transport fluid passage such that the partially atomised working fluid is further atomised by a flow of transport fluid in the first transport fluid passage prior to the flow of transport fluid in the first transport fluid passage exiting an outlet nozzle in fluid communication with the respective first transport fluid and working fluid outlets;

(d) imparting a shear force on the working fluid in the working fluid passage by way of the second portion of the transport fluid exiting the outlet of the second transport fluid passage, thereby partially atomising the working fluid as it passes through the working fluid passage; and (e) directing the partially atomised working fluid and the first portion of transport fluid to the outlet nozzle, wherein the respective outlets are arranged such that the first portion of transport fluid flow imparts a further shear force on the partially atomised working fluid to atomise the working fluid still further prior to the first portion of the transport fluid exiting the outlet nozzle.

12. A method of generating a mist as claimed in claim 11, wherein the second portion of the transport fluid is directed to the second transport fluid passage from the first transport fluid passage.

13. A method of generating a mist as claimed in claim 11, wherein the step of supplying the second portion of the transport fluid through the at least one second transport fluid passage includes directing transport fluid in the first transport passage to an inlet of the second transport fluid passage located upstream of the throat portion of the first transport fluid passage.

14. A method of generating a mist as claimed in claim 11, wherein the method comprises the further step of creating a stationary aerodynamic shockwave in the first transport fluid passage.

15. A method of generating a mist as claimed in claim 14, wherein the step of creating the stationary aerodynamic shockwave includes the step of passing the transport fluid over a protrusion or a recess in the first transport fluid passage.

16. A method of generating a mist as claimed in claim 14, wherein the method comprises the further step of passing the atomised working fluid through the stationary aerodynamic shockwave to atomise the working fluid further still.

17. A system for generating a mist comprising an apparatus according to claim 1.

18. A mist made by the method according to claim 11.

19. A method for decontaminating an area including an article within the area comprising generating and distributing a decontamination mist within the area and/or on a surface of the article, wherein the decontamination mist is generated and distributed using an apparatus comprising:

(a) a first transport fluid passage disposed around a longitudinal axis and having a first transport fluid inlet, a first transport fluid outlet, and a converging throat portion intermediate the first transport fluid inlet and the first transport fluid outlet, the throat portion having a cross sectional area which is less than that of either the first transport fluid inlet or the first transport fluid outlet;

(b) at least one working fluid passage disposed around the longitudinal axis, located radially outwardly, from the longitudinal axis, and circumscribing the first transport fluid passage, and having a working fluid inlet and a working fluid outlet;

(c) at least one second transport fluid passage disposed around the longitudinal axis and having a second transport fluid inlet and a second transport fluid outlet in fluid communication with the working fluid passage; and (d) an outlet nozzle in fluid communication with the first transport fluid and working fluid outlets, wherein the second transport fluid outlet being located in the working fluid passage upstream of the working fluid outlet so that a transport fluid in the second transport fluid passage partially atomises a working fluid within the working fluid passage to create a partially atomised working fluid, the partially atomised working fluid exiting the working fluid outlet and entering the first transport fluid passage such that the partially atomised working fluid is further atomised by a flow of transport fluid in the first transport fluid passage prior to the flow of transport fluid in the first transport fluid passage exiting the outlet nozzle.

20. A fire suppression method comprising generating and distributing within an area a mist sufficient to suppress a fire within the area using an apparatus comprising:

(a) a first transport fluid passage disposed around a longitudinal axis and having a first transport fluid inlet, a first transport fluid outlet, and a converging throat portion intermediate the first transport fluid inlet and the first transport fluid outlet, the throat portion having a cross sectional area which is less than that of either the first transport fluid inlet or the first transport fluid outlet;

(b) at least one working fluid passage disposed around the longitudinal axis, located radially outwardly, from the longitudinal axis, and circumscribing the first transport fluid passage, and having a working fluid inlet and a working fluid outlet;

(c) at least one second transport fluid passage disposed around the longitudinal axis and having a second transport fluid inlet and a second transport fluid outlet in fluid communication with the working fluid passage; and (d) an outlet nozzle in fluid communication with the first transport fluid and working fluid outlets, wherein the outlet of the second transport fluid outlet being located in the working fluid passage upstream of the working fluid outlet so that a transport fluid in the second transport fluid passage partially atomises a working fluid within the working fluid passage to create a partially atomised working fluid, the partially atomised working fluid exiting the working fluid outlet and entering the first transport fluid passage such that the partially atomised working fluid is further atomised by a flow of transport fluid in the first transport fluid passage prior to the flow of transport fluid in the first transport fluid passage exiting the outlet nozzle.

21. An apparatus for generating a mist as claimed in claim 1, wherein the working fluid outlet is located in the throat portion of the first transport fluid passage.

* * * * *